United States Patent [19]

Dunleavy

[11] Patent Number: 4,471,600

[45] Date of Patent: Sep. 18, 1984

[54] LEAF BAGGING EQUIPMENT AND METHOD

[76] Inventor: Daniel W. Dunleavy, 1315 N. Line St., Lansdale, Pa. 19446

[21] Appl. No.: 104,007

[22] Filed: Dec. 17, 1979

[51] Int. Cl.[3] ..... B65B 1/04; B65B 1/06; B65B 7/06

[52] U.S. Cl. ..... 53/468; 53/469; 53/390; 15/257.7; 383/127

[58] Field of Search ..... 53/390, 469, 468, 459, 53/473; 150/1, 2; 15/257.4, 257.7; 294/1 B, 55; 248/95, 99; 141/390, 391

[56] References Cited

U.S. PATENT DOCUMENTS

| | | | |
|---|---|---|---|
| 2,975,863 | 3/1961 | Sosnowich | 229/62 X |
| 3,204,855 | 9/1965 | Boynton et al. | 229/53 |
| 3,676,887 | 7/1972 | Klein | 229/62 X |
| 3,739,418 | 6/1973 | Yonaites et al. | 229/62 X |
| 3,806,984 | 4/1974 | Hilsabeck | 15/257.7 X |

*Primary Examiner*—Horace M. Culver
*Attorney, Agent, or Firm*—Raymond Underwood

[57] ABSTRACT

A leaf collecting and bagging assembly is made up of a plastic bag having an open end and sheet means of plastic material integral with the bag and attached thereto around its opening, the integral sheet means being capable of being spread out on the ground to serve as a leaf collecting surface.

3 Claims, 8 Drawing Figures

LEAF BAGGING EQUIPMENT AND METHOD

This invention relates to leaf bagging equipment and particularly to an assembly which provides a collecting surface on which the leaves are to be gathered and also provides as an integral part thereof a trash bag to receive the gathered leaves and store them for disposal with the bag. The invention also includes the method of using the assembly for collecting and disposing of leaves.

An assembly and a method for readily collecting leaves and bagging them for disposal is disclosed and claimed in my copending patent application filed on May 25, 1978 as Ser. No. 910,076 having the same title of this present application and which issued as U.S. Pat. No. 4,200,127. That apparatus and method have proved to be fully satisfactory for collecting and disposing of leaves. Commercial production and sale of a product within the scope of the patent has shown that it is eminently effective in assisting in the chore of getting rid of leaves.

The commercial product, however, has had the possible disadvantage that its manufacturing cost has been somewhat high and consequently it is relatively expensive for the consumer to buy it. If the user foresees only a limited use of the assembly his sales resistance prevents him from buying it despite its obvious benefits in making a difficult job an easy one. The need for a cheaper product has become apparent.

In accordance with the present invention an inexpensive leaf gathering and bagging assembly is provided. This low cost is made possible because the entire assembly is made up of inexpensive sheet plastic and in fact the article can be made so cheaply that when it is filled with leaves the entire assembly may be discarded as a trash item. It can be entirely made up of as few as two parts which are heat fused together and the entire manufacturing operation is reduced to a bare minimum and cost.

As is stated in my patent, the invention will be described with special reference to tree leaves but it is to be understood that the word "leaves" is used herein in a generic sense and is intended to include other debris which is to be gathered together and deposited in a trash bag for disposal. Such debris includes wood shavings, small cut pieces and the like, which are generally swept or raked together and then picked up and placed in a bag which is to be discarded Representative embodiments of the invention are illustrated in the drawings in which.

Figure 4:
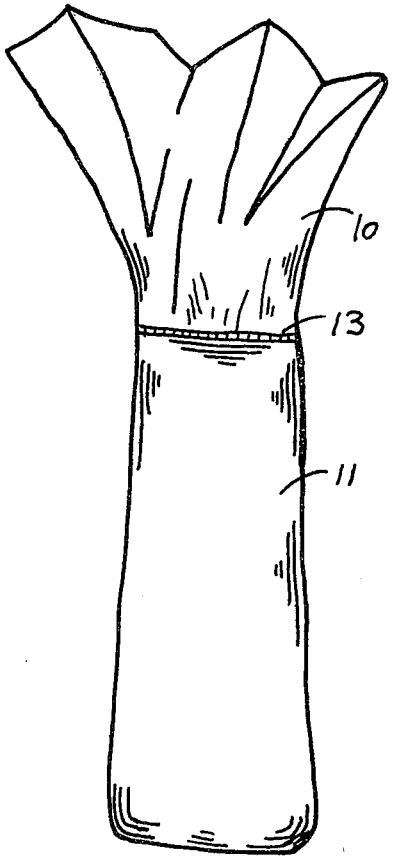
Figure 5:
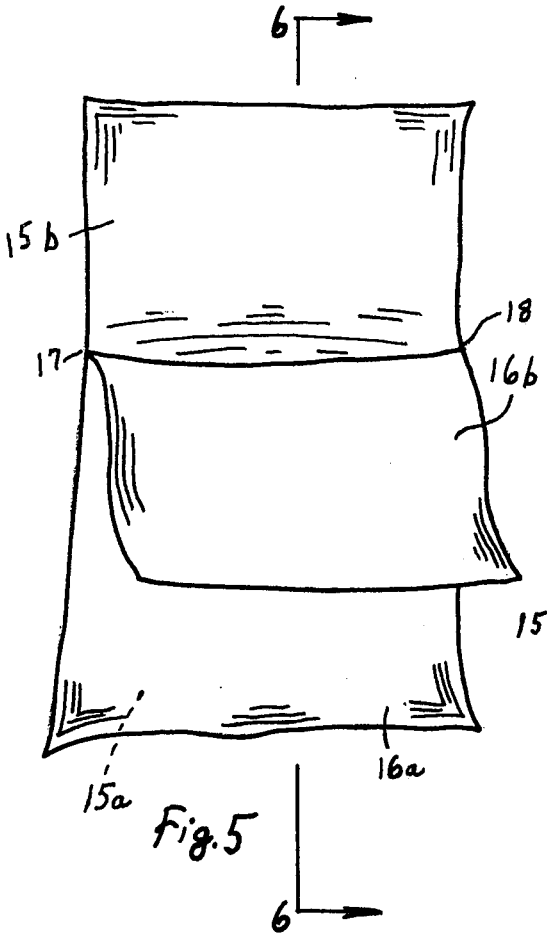
Figure 6:
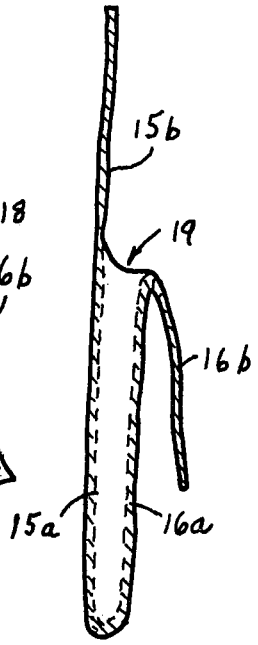
Figure 8:
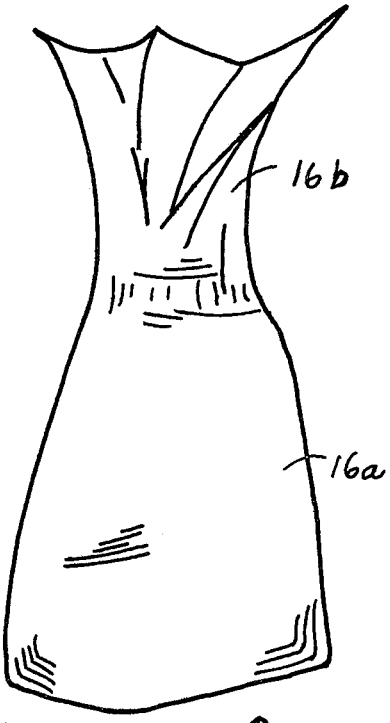
Figure 7:
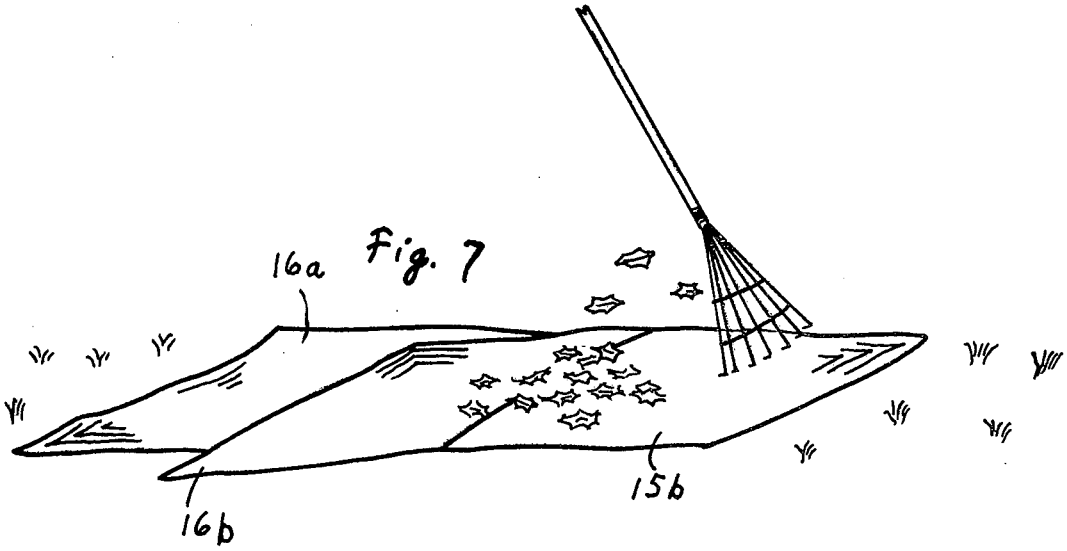

FIG. 4 is a side elevation showing how the leaves are being shaken in the underlieing trash bag, of FIGS. 1, 2 and 3, FIG. 5 is a plan view of a modified form of the assembly, FIG. 6 is a section on the line 6—6 of FIG. 5, FIG. 7 is a perspective showing the assembly in use and FIG. 8 is a side elevation showing how the leaves are being shaken into the trash bag of FIGS. 5, 6 and 7.

Referring first to the preferred structure of FIGS. 1 to 4, it is made up of the sheet or blanket 10 and the trash bag 11. The sheet 10 is preferably square in outline but it may be rectangular and may even have slightly curved sides. It has a hole 12 about at its center and it preferably is a narrow, elongated oval as is shown but it could be circular.

The edge of the bag 11 at its open end is fused to the edge of the hole 12 as is indicated at the seam 13. This means that the hole 12 should correspond to the size of the bag so that a complete seam will join the bag 11 and the sheet 10.

A good size for the sheet 10 is five or six feet square but it may be smaller or larger to fit the particular use that is contemplated. Both the sheet and the bag will ordinarily be of the same heat fusible plastic and have the same thickness, but this is not an absolute requirement. An appropriate thickness of the plastic is 3.0 mil (0.003 inch) but it could range from about 1.5 mil to about 5.0 mil.

Figure 1:
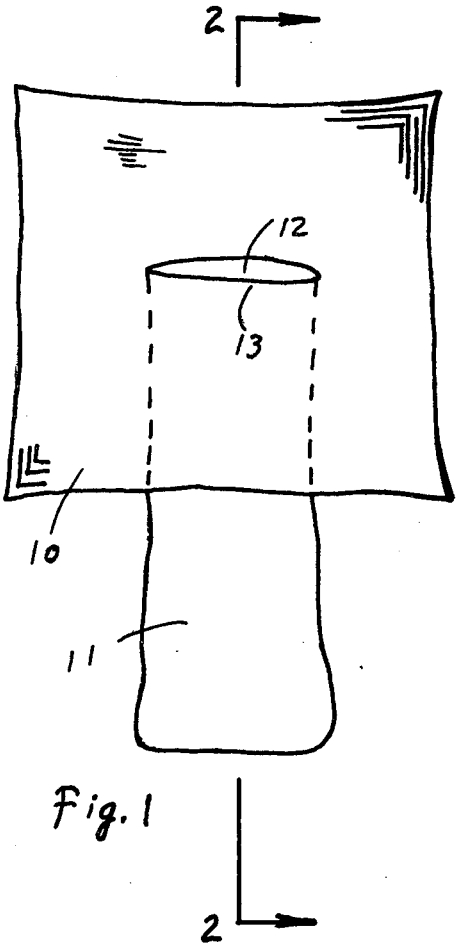
FIG. 1 is a plan view of a preferred form of the assembly.
Figure 2:
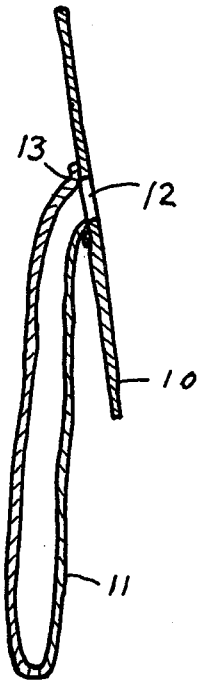
FIG. 2 is a section on the line 2—2 of FIG. 1.

The hole 12 may be a mere slit at the center of the sheet but it could be an oval or even a circle as is mentioned above. The edge of the material at the hole and the edge at the bag opening are simply brought together as is shown in FIG. 2 and heat such as from an electric iron is applied to form the seam at 13. The small amount of labor which is required and the obviously low cost of the material make it possible to sell the product at a low price.

Figure 3:
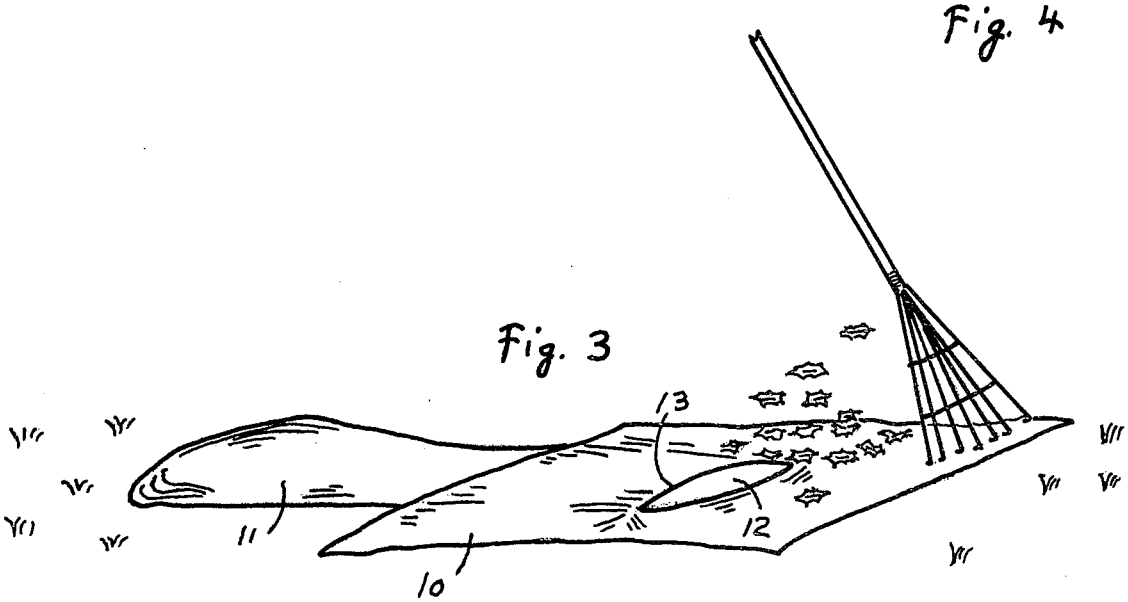
FIG. 3 is a perspective view showing the assembly in use.

The use of the assembly is shown in FIG. 3 as it is spread out flat on the ground in the area where the leaves or other debris are; the bag is underneath the sheet as is illustrated. Then the leaves are swept or raked on the top of the sheet until they are piled quite high. The four corners of the sheet are now picked up and brought together at a height above the suspended bag and when the sheet is shaken the leaves pass through the hole 12 and fall into the bag as will be clear from FIG. 4.

The assembly is again laid on the ground and spread out and the leaves which are in the bag will not prevent the collection of another load of leaves on the blanket. They can be shaken into the bag and the entire action can be repeated until the bag is full. The bag can be tied at the top and be discarded or it is posible to stuff the sheet inside of the bag and then tie it closed.

It is obvious that the extremely low cost of the sheet portion 10 of this assembly makes it possible to discard it with each use whereas this would be economically impractical with the expensive fabric blanket of my above-mentioned patent. Both products require the use and loss of the trash bag itself for each clean-up job and the additional loss of the sheet 10 of the present assembly is immaterial considering its low value and the elimination of the attachment steps required with the composite assembly of my patent.

The modification of FIGS. 5 to 8 has features in common with the preferred structure of FIGS. 1 to 4. In effect, the product in FIG. 5 is similar ot that of FIG. 1 except for the fact that the apparent sheet of FIG. 5 is only as wide as the bag itself. The arrangement of FIG. 5 is made up of a lower plastic piece or sheet 15*a*–15*b* and an upper plastic piece or sheet 16*a*–16*b* of like size. They are fused together around three edges up to the points 17 and 18 so as to leave the entrance hole or mouth 19.

The portions 15*a* and 16*a* thus form a trash bag to receive and hold the leaves and the portions 15*b* and 16*b* form a collecting sheet when they are spread out as is shown in FIG. 5. When this assembly is spread out on the ground as is shown in FIG. 7, leaves may be raked on the outspread sections 15*b* and 16*b* in much the same manner that leaves are roked on the sheet 10 in FIG. 3.

The two free corners of 15*b* and the two free corners of 16*b* are then brought together and picked up and shaken so that the leaves fall down into the bag formed by sections 15*a* and 16*a*. This similarity of structure and use is apparent from a comparison of the similarities of FIGS. 4 and 8. The similarity of the entrance hole or mouth 19 to the entrance hole or mouth 12 are apparent. The possible variations in size of the assembly of FIG. 5 to fit specific needs are obvious.

One suitable material for the assembly is low density polyethylene plastic but other plastics which may be fused to form a bag by edge sealing, may be used.

I claim:

1. A leaf collecting and bagging assembly comprising a flexible plastic bag having an open end and integral therewith a flexible plastic sheet means having discrete sides, said sheet means being attached to the bag around its opening, the integral sheet means having a central opening therethrough and the material of the bag and sheet means being integrally connected around their openings, the sheet means being from five to six feet on each side and capable of being spread out on the ground to serve as a leaf collecting surface on which leaves may be raked or swept while the plastic sheet means remains on the ground.

2. The method of collecting and bagging leaves which comprises spreading out on the ground a plastic sheet means which is from five to six feet on a side and has a central opening and which is integral with a plastic trash bag by being attached thereto at their openings, collecting leaves by raking or sweeping them on the sheet means as it remains in place on the ground, picking up the sheet means at its periphery to form a funnel which directs the leaves into the bag and discarding the entire assembly.

3. The method of claim 2 in which the sheet means is stuffed in the bag before the assembly is discarded.

* * * * *